US006474003B2

(12) United States Patent
Erickson et al.

(10) Patent No.: US 6,474,003 B2
(45) Date of Patent: Nov. 5, 2002

(54) FOOTBED SYSTEM WITH VARIABLE SIZED HEEL CUPS

(75) Inventors: John J. Erickson, Brockton, MA (US); Douglas K. Robinson, Mansfield, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/028,291

(22) Filed: Dec. 28, 2001

(65) Prior Publication Data

US 2002/0083618 A1 Jul. 4, 2002

Related U.S. Application Data

(62) Division of application No. 09/573,341, filed on May 18, 2000, now Pat. No. 6,408,543.

(51) Int. Cl.[7] ..... A43B 3/24

(52) U.S. Cl. ..... 36/100

(58) Field of Search ..... 36/100, 127, 28, 36/29, 44, 43

(56) References Cited

U.S. PATENT DOCUMENTS

| | | | | | |
|---|---|---|---|---|---|
| 492,994 | A | * | 3/1893 | Sawyer | 36/140 |
| 1,741,419 | A | | 12/1929 | Jones | |
| 1,919,862 | A | | 7/1933 | Rohn et al. | |
| 1,920,112 | A | | 7/1933 | Shaft | |
| 1,942,001 | A | | 1/1934 | Rohn et al. | 36/17 |
| 2,051,072 | A | | 8/1936 | Brown et al. | 36/71 |
| 2,055,072 | A | | 9/1936 | Everston | 36/28 |
| 2,126,601 | A | | 8/1938 | Bain | 12/142 |
| 2,348,300 | A | | 5/1944 | Klaus | 36/8.5 |
| 2,403,442 | A | | 7/1946 | Klaus | 36/8.5 |
| 2,414,707 | A | * | 1/1947 | Barnett | |
| 2,482,333 | A | | 9/1949 | Everston | 36/43 |
| 2,502,774 | A | | 4/1950 | Alianiello | 36/28 |
| 2,598,782 | A | | 6/1952 | Gillis | 36/2.5 |
| 2,772,488 | A | | 12/1956 | Meltzer | 36/2.5 |
| 2,865,097 | A | | 12/1958 | Vollrath, Jr. et al. | 30/43 |
| 2,924,849 | A | | 2/1960 | Buchman | 18/5.1 |
| 2,952,925 | A | | 9/1960 | Held | 36/2.5 |
| 3,068,872 | A | | 12/1962 | Brody | 128/595 |
| 3,309,797 | A | | 3/1967 | Poitras | 36/80 |
| 3,333,353 | A | | 8/1967 | Garcia | 36/68 |
| 3,466,763 | A | | 9/1969 | Levin | 36/2.5 |
| 3,545,447 | A | | 12/1970 | Silverman | 128/583 |
| 3,616,170 | A | | 10/1971 | Closson, Jr. | 161/159 |
| 4,103,440 | A | * | 8/1978 | Lawrence | 36/101 |
| 4,287,675 | A | | 9/1981 | Norton et al. | 36/129 |
| 4,346,525 | A | | 8/1982 | Larsen et al. | 36/69 |
| 4,435,910 | A | | 3/1984 | Marc | 36/44 |
| 4,494,321 | A | | 1/1985 | Lawlor | 36/28 |
| 4,510,700 | A | | 4/1985 | Brown | 36/44 |
| 4,557,060 | A | | 12/1985 | Kawashima | 36/44 |
| 4,694,590 | A | | 9/1987 | Greenawalt | 36/91 |
| 4,718,179 | A | | 1/1988 | Brown | 36/44 |

(List continued on next page.)

FOREIGN PATENT DOCUMENTS

| | | |
|---|---|---|
| CH | 279264 | 3/1952 |
| DE | 4403889 A1 | 8/1994 |
| FR | 381566 | 11/1907 |

*Primary Examiner*—Ted Kavanaugh
(74) *Attorney, Agent, or Firm*—Swidler Berlin Shereff Friedman, LLP

(57) ABSTRACT

A footbed system is disclosed which includes at least one sole pad and at least two heel cups. Each heel cup including a base and a side wall extending from the base on the medial and lateral sides thereof. The volume of the side walls of each heel cup is varied to accommodate different width heels of users. The volume is modified by changing the height and/or thickness of the heel cup side walls. A cushion is coupled to the lower surface of the sole pad in a forefoot region and a damper is coupled to the lower surface of the sole pad in a heel region. The sole pad is detachably connectable to the heel cup that best accommodates the user's heel width.

23 Claims, 7 Drawing Sheets

U.S. PATENT DOCUMENTS

| | | | | | |
|---|---|---|---|---|---|
| 4,800,657 | A | | 1/1989 | Brown | 36/44 |
| 4,803,747 | A | | 2/1989 | Brown | 12/142 N |
| 4,841,648 | A | | 6/1989 | Shaffer et al. | 36/43 |
| 4,910,886 | A | | 3/1990 | Sullivan et al. | 36/44 |
| 4,918,838 | A | | 4/1990 | Chang | 36/28 |
| 4,932,141 | A | | 6/1990 | Hones | 36/43 |
| 4,962,593 | A | | 10/1990 | Brown | 36/44 |
| RE33,648 | E | | 7/1991 | Brown | 36/44 |
| 5,068,983 | A | | 12/1991 | Marc | 36/44 |
| 5,092,060 | A | | 3/1992 | Frachey et al. | 36/29 |
| 5,146,698 | A | | 9/1992 | Tilles et al. | 36/44 |
| 5,152,081 | A | | 10/1992 | Hallenbeck et al. | 36/28 |
| 5,175,946 | A | | 1/1993 | Tsai | 36/29 |
| 5,255,451 | A | | 10/1993 | Tong et al. | 36/30 A |
| 5,311,674 | A | | 5/1994 | Santiyanont et al. | 36/28 |
| 5,369,896 | A | | 12/1994 | Frachey et al. | 36/29 |
| 5,394,626 | A | | 3/1995 | Brown | 36/44 |
| 5,400,528 | A | | 3/1995 | Skinner et al. | 36/161 |
| 5,435,078 | A | | 7/1995 | Pyle | 36/30 R |
| 5,438,768 | A | | 8/1995 | Bauerfeind | 36/44 |
| 5,463,824 | A | * | 11/1995 | Barna | 36/173 |
| 5,493,792 | A | * | 2/1996 | Bates et al. | 36/153 |
| 5,517,770 | A | | 5/1996 | Martin et al. | 36/43 |
| 5,564,202 | A | * | 10/1996 | Hoppenstein | 36/25 R |
| 5,570,523 | A | | 11/1996 | Lin | 36/112 |
| 5,611,153 | A | | 3/1997 | Fisher et al. | 36/43 |
| 5,659,980 | A | | 8/1997 | Lin | 36/112 |
| 5,682,687 | A | | 11/1997 | Arai | 36/97 |
| 5,787,609 | A | | 8/1998 | Wu | 36/28 |
| 5,842,294 | A | | 12/1998 | Fabricant | 36/127 |
| 5,896,681 | A | | 4/1999 | Lin | 36/28 |
| 5,896,682 | A | | 4/1999 | Lin | 36/29 |
| 5,918,383 | A | | 7/1999 | Chee | 36/28 |
| 6,408,543 | B1 | * | 6/2002 | Erickson et al. | 36/100 |

* cited by examiner

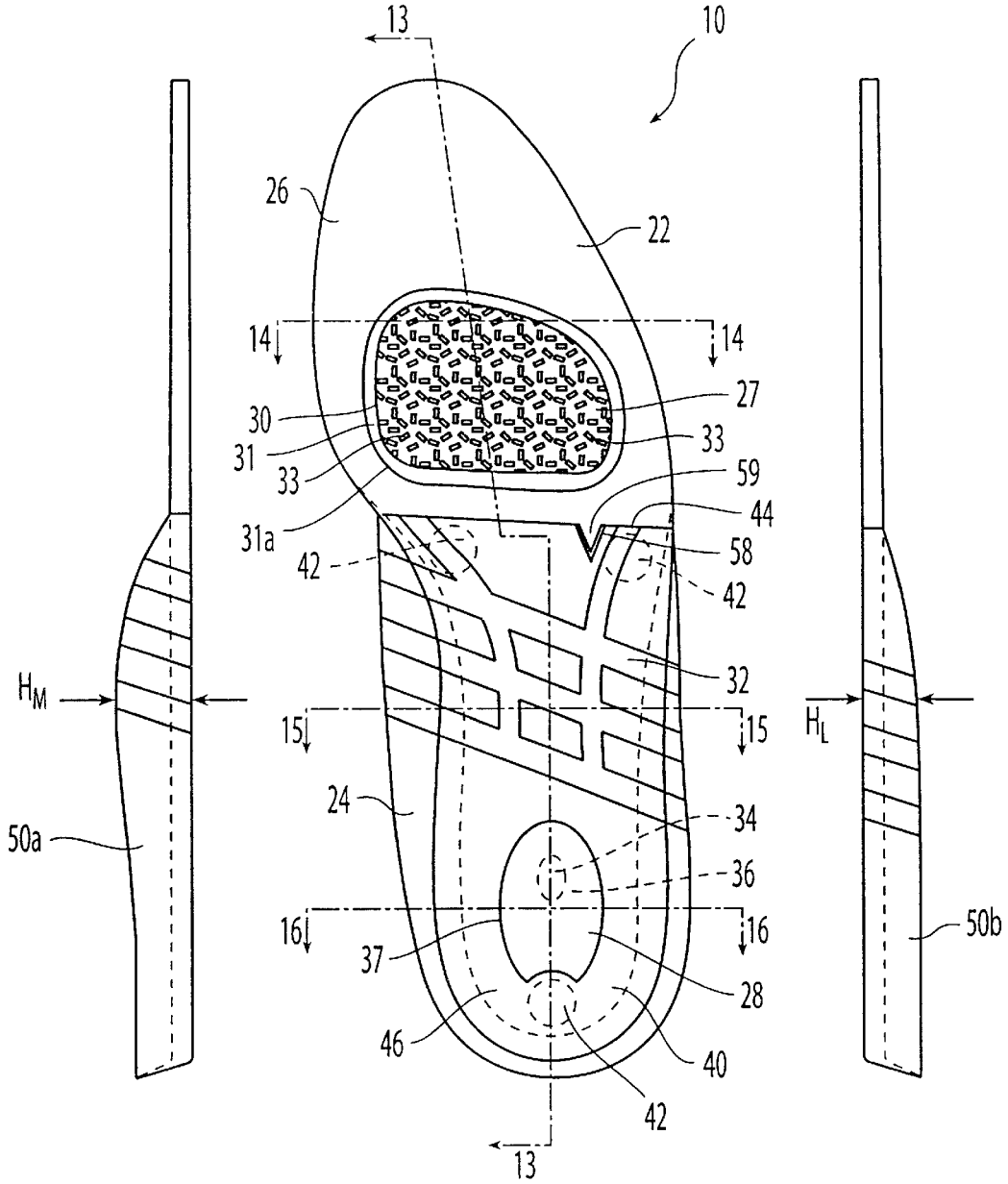
*Fig. 6* *Fig. 5* *Fig. 7*

FOOTBED SYSTEM WITH VARIABLE SIZED HEEL CUPS

CROSS-REFERENCE TO RELATED APPLICATIONS

This application is a Division of U.S. patent application Ser. No. 09/573,341 filed May 18, 2000, which is incorporated herein by reference in its entirety.

TECHNICAL FIELD OF THE INVENTION

The present invention relates to shoes, and more particularly, relates to a removable footbed system with variable sized heel cups for use with golf shoes.

BACKGROUND OF THE INVENTION

A golfer's performance depends substantially on the ability of the golfer's shoes to provide a solid base of support. To that end, golf shoes generally include a shoe upper joined to an outsole to define a chamber for receiving the golfer's foot. Furthermore, the bottom surface of the outsole includes numerous cleats for providing traction.

The traction provided by the cleats upon interaction between the outsole and the ground enables the golfer to perform the body movements necessary to culminate in an ideal contact between the club head and the ball (i.e., a golf swing), if the shoes fit properly. If the shoes are too loose in the heel area, a golfer's foot can move relative to the ground which is undesirable. Since the majority of golfers cannot afford custom made shoes, they must wear shoes of a pre-made size that best fit their feet. In order to improve fit, insertable shoe insoles are commonly used. These insoles also provide cushioning and arch support for a user's foot.

One example of such an insole is disclosed in U.S. Pat. No. 5,068,983 to Marc. The shoe insole in this patent includes a resilient base piece that is disposed primarily at the heel area and has a cupped peripheral wall. A heel piece is disposed within the base piece and provides shock absorption at the heel. A top cushioning layer overlies the base and heel pieces and is affixed to them with an adhesive. The top cushioning layer extends from the heel area forwardly to underlie the ball and toe areas.

There remains, however, a need in the art for other insoles, which are easy to manufacture and improve the fit of user's feet within their shoes.

SUMMARY OF THE INVENTION

The invention relates to a footbed system at least two heel cups. Each heel cup includes a base and a side wall that extends upwardly from the base. The first heel cup has a first volume of the side wall and the second heel cup has a second volume of the side wall, with the second volume is different from the first volume. One, selected heel cup is used. The narrower the heel width the greater the volume of the side walls of the heel cup are to assure good fit.

In another embodiment, the footbed system further includes a sole pad detachably connectable to the selected heel cup. In yet another embodiment, the footbed system includes a third heel cup with a third volume of the side wall is different from the first and second volumes.

Preferably, the first and second volumes are different adjacent a user's heel, and modified by changing the heights and/or thicknesses of the heel cups.

A cushion may be coupled to the lower surface of the sole pad in a forefoot region, and a viscoelastic damper may be coupled to the lower surface of the sole pad in a heel region. Fasteners may be included for to detachably connect the sole pad to each heel cup. The height of the side walls of the heel cups rearward of a shank area may additionally be varied.

The present invention further concerns a shoe that includes an upper, a midsole, an outsole, at least one sole pad, and a heel cup selected from at least two heel cups. Each heel cup includes a base and a side wall that extends from the base, with the first heel cup has a first volume of the side wall and the second heel cup has a second volume of the side wall. The second volume is different from the first volume. The selected heel cup is detachably connected to the sole pad to form a footbed system. The upper, midsole, and outsole are joined together to define an opening for receiving the footbed system.

The present invention is also related to a method of providing variable fit for a pair of shoes, the method including: providing a first sole pad, providing a first set of first heel cups of variable sizes, each first heel cup has side walls of different volumes from one another, selecting the first heel cup that provides preferred fit for a first foot, detachably connecting the first sole pad to the first selected heel cup to form a first footbed system, with the first selected heel cup underlying the first sole pad; and inserting the first footbed system in one shoe. The method may further include: providing a second sole pad; providing a second set of second heel cups of variable sizes, each second heel cup has side walls of different volumes from one another; selecting the second heel cup that provides preferred fit for a second foot, detachably connecting the second sole pad to the second selected heel cup to form a second footbed system, with the second selected heel cup underlying the second sole pad; and inserting the second footbed system in the remaining shoe.

BRIEF DESCRIPTION OF THE DRAWINGS

To facilitate the understanding of the characteristics of the invention, the following drawings have been provided wherein:

FIG. 5 is a bottom view of the footbed system of the present invention,

FIG. 6 is a side view of a medial side of the footbed system of FIG. 5;

FIG. 7 is a side view of a lateral side of the footbed system of FIG. 5;

DESCRIPTION OF THE PREFERRED EMBODIMENTS

Figure 1:
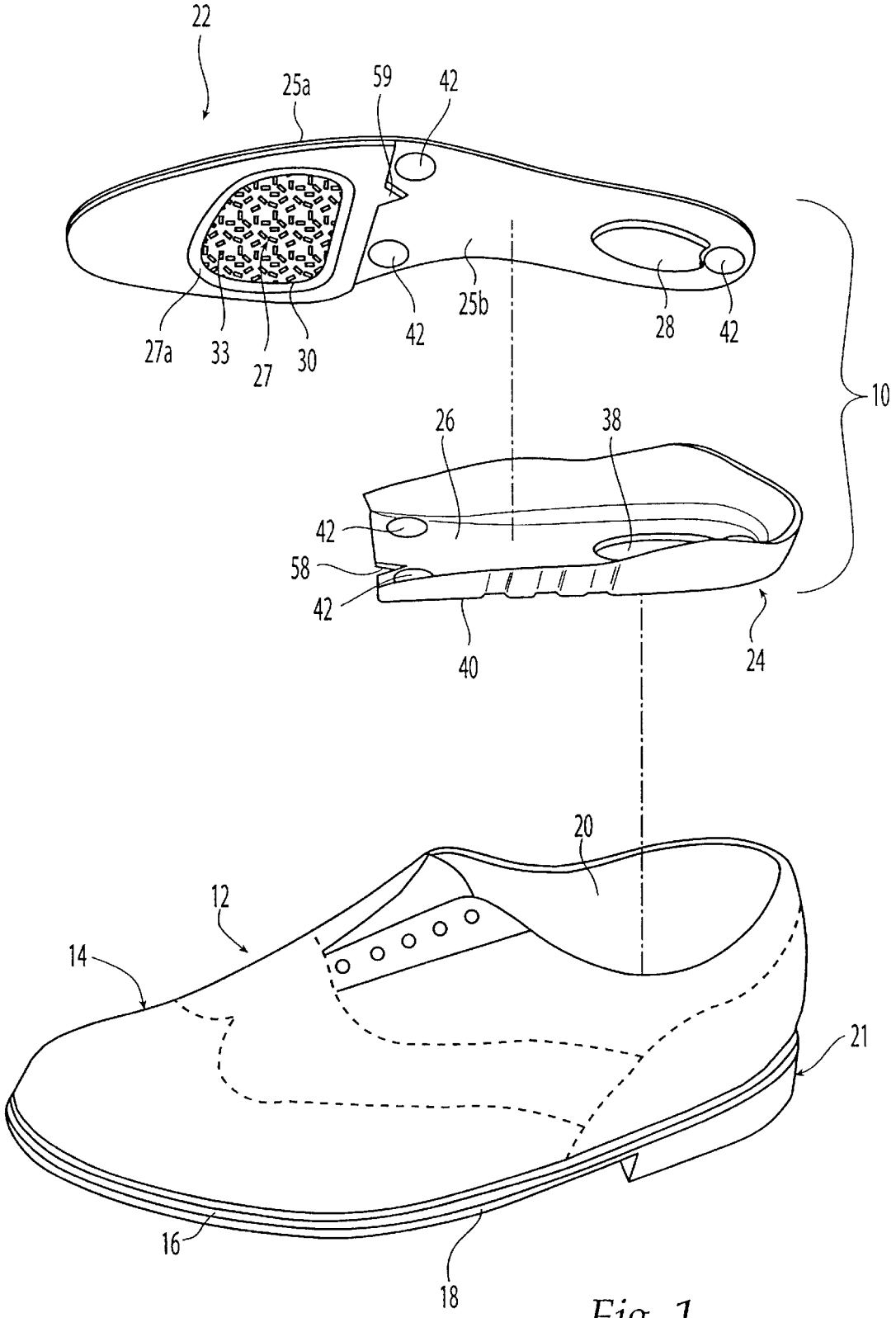
FIG. 1 is an exploded, perspective view of a footbed system of the present invention for placement in a shoe.

Referring to the drawings, wherein like reference numbers are used to designate like parts, and as shown in FIG. 1, there is illustrated an embodiment of a footbed system 10 for placement in a golf shoe 12 according to the present development. Golf shoe 12 includes an upper 14, a midsole 16, and an outsole 18. The upper 14 is conventional and formed from a suitable material, such as leather, a synthetic material or the like. The upper 14 is joined to the midsole 16 using cement or the like and conventional techniques. Once joined thereto the upper 14 defines an opening 20 for receiving the footbed system 10 and a wearer's foot (not shown).

The midsole 16 provides cushioning to the wearer, and is formed of a material such as ethylene vinyl acetate copolymer (EVA). The midsole 16 is formed on the outsole 18. Once the midsole and outsole are joined, the outsole forms the bottom of shoe 12.

Referring to FIGS. 1–5, footbed system 10 includes a sole pad 22 and a heel cup 24, both of which are preferably formed of EVA. Perforations (not shown) may be provided through sole pad 22 for enhanced breathability. Sole pad 22 has a fabric-covered top side 25*a* and a bottom side 25*b*, and underlies substantially the entire length of the user's foot. The heel cup 24 also has a fabric-covered top side 26*a* and a bottom side 26*b*. The EVA is lightweight, and the polymer/fabric composite effectively handles the moisture that develops at the base of the foot. The sole pad and base are formed as separate, single molded pieces with the recesses and other portions as discussed below formed therein during molding. The holes are subsequently die cut.

Figure 14:
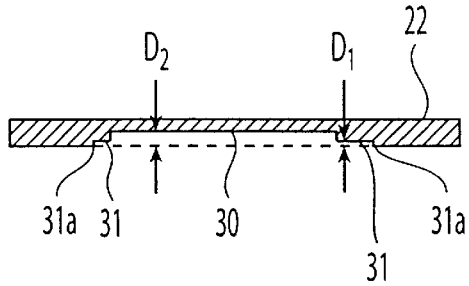
FIG. 14 is a cross-sectional view of the footbed system shown in FIG. 5 along the line 14—14 of FIG. 5 without the cushion.

The sole pad 22 further includes cushion 27 provided in the forefoot area and a damper 28 in the heel area. Preferably, the cushion 27 fits within a recess 30 (as best seen in FIG. 14) on the bottom side 25*b* of sole pad 22, and includes a recess peripheral portion 31 that extends to a peripheral edge 31*a*.

The cushion 27 may be, for example, a soft polymer pad, an air bladder, or a bladder filled with a cushioning material like a gel or liquid. Most preferably, the cushion is formed by filling a plastic bladder with air and small discrete pieces of cushioning material such as pellets 33. The pellets 33 are formed of thermoplastic rubber (TPR) with a Shore A hardness of between about 5 to about 15, and more preferably about 10. The pellets 33 have a generally cylindrical shape. However, pellets of other shapes can also be used. Such pellets have rubbery properties which permit deformation and thus serve as an effective cushioning material. The bladder is glued, bonded, or otherwise connected to the bottom side of sole pad 22, thereby encasing pellets 33 within recess 30. The contents of the cushion 27, such as pellets, and air. It is recommended that the pellets 33 are at least 4 grams per piece.

Figure 2:
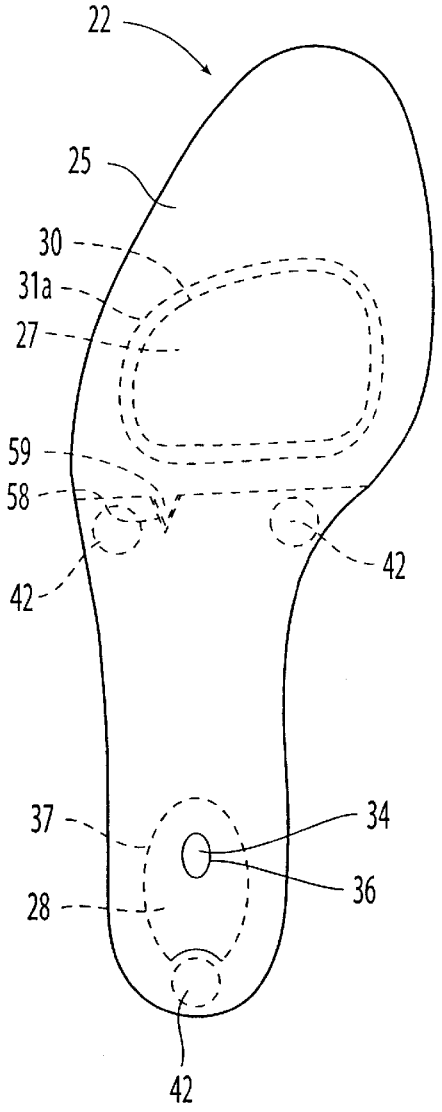
FIG. 2 is a top view of a sole pad of the present invention.
Figure 3:
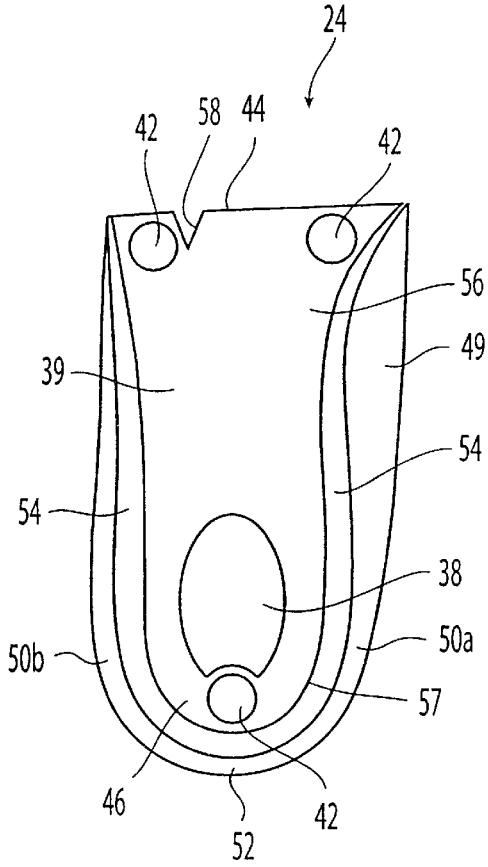
FIG. 3 is a top view of a heel cup of the present invention.

Referring to FIGS. 2 and 3, damper 28 (shown in phantom) preferably has a generally oval shape, and has a protrusion 34 that fits in a locating hole 36 in sole pad 22. The remaining portion of the damper 28, less the protrusion 34, fits in a recess 37 in sole pad 22. The damper is permanently attached to sole pad 22 by adhesive, thermal, or other bonding techniques. Damper 28 is accommodated in a matching hole 38 that extends through heel cup 24. The damper 28 and hole 38 are configured and dimensioned so that damper 28 fits snugly in hole 38 and has about the same thickness as heel cup 24. Alternate shapes may also be used for damper 28, such as a circle or two partially-overlapping ovals. The damper may be formed of materials including viscoelastic materials, such as a polyurethane gel.

In another embodiment, cushion 27 and damper 28 can be removably attached to sole pad 22. Additionally, damper 28 may instead be accommodated in a matching recess in the top side 26*a* of heel cup 24 instead of the hole 38 therethrough.

Referring again to FIGS. 2 and 3, sole pad 22 is detachably connected to heel cup 24, such as by hook and loop fasteners 42. Preferably, separate, matching, circular-shaped fasteners are adhered in recessed areas on both sole pad 22 and heel cup 24, with the fastener hook portion adhered to one and the fastener loop portion adhered to the other. To adequately secure sole pad 22 to heel cup 24, fasteners 42 are located near a front edge 44 and a rear area 46 of heel cup 24, and fasteners are secured at the rear and middle of the sole pad 22. Although hook and loop fasteners have been used to attach a sole pad to a heel cup, the type of fasteners can vary.

Figure 4:
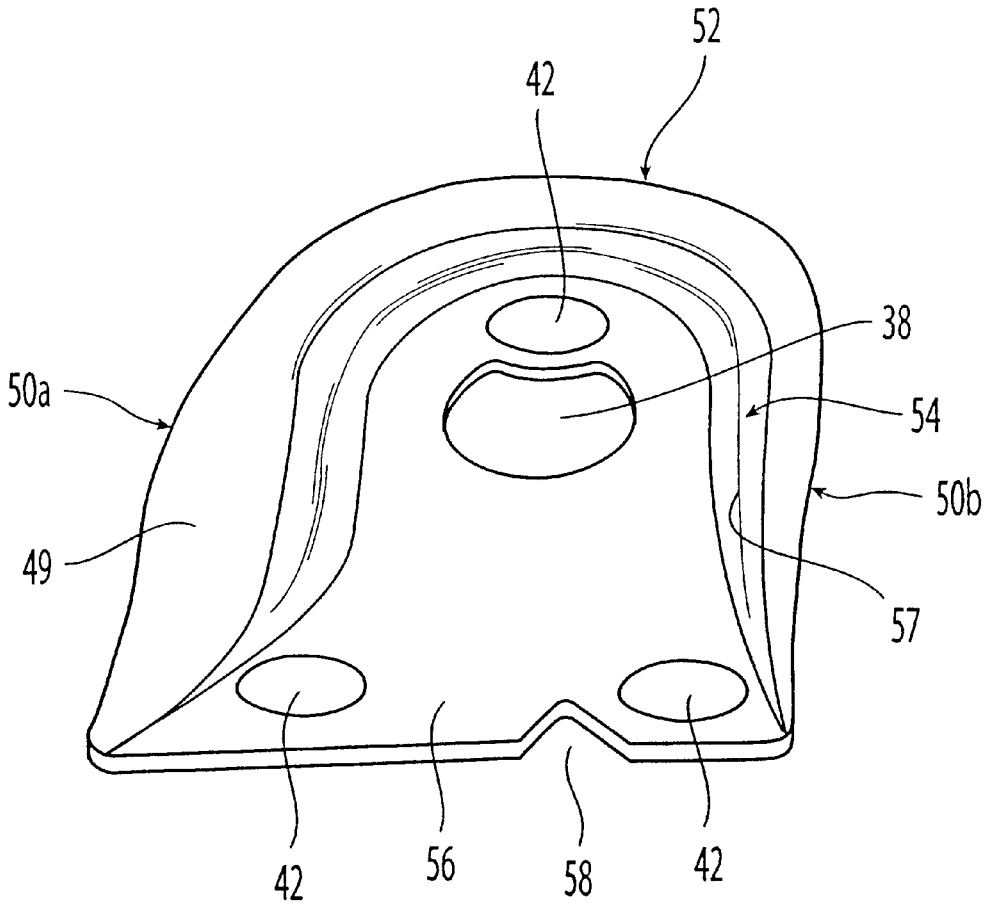
FIG. 4 is a front, perspective view of the heel cup of FIG. 3.
Figure 15:
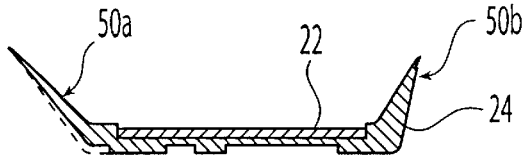
FIG. 15 is a cross-sectional view of the footbed system shown in FIG. 5 along the line 15–15 of FIG. 5.

Referring to FIGS. 3 and 4, the heel cup 24 further includes side walls 50*a* and 50*b*, and back wall 52, surrounding a raised platform area 54. Side walls 50*a,b* and back wall 52 extend upwardly from platform area 54, which extends above base 56. The medial side wall 50*a* is configured at arch portion 49 to support the arch area of a user's foot. Notably, the inward slope of the lateral side wall 50*b* is significantly more steep that the inward slope on the medial side wall 50*a* (as best seen in FIG. 15). When sole pad 22 is placed on top of heel cup 24 on base 56, top side 25*a* of sole pad 22 (as shown in FIG. 1) is slightly below the inside edge 57 of raised platform area 54. Criss-crossing indentations 32 (as best seen in FIG. 5) also may be provided along the bottom side of heel cup 24.

Referring again to FIGS. 2 and 3, different configurations of sole pads 22 and heel cups 24 must be provided for the left foot and the right foot. In particular, because the arch is located on the medial side of the foot, the heel cup arch portion 49 must be provided on the medial side of heel cup 24. In order to facilitate the proper matching of sole pad 22 configured for a left foot and shoe with heel cup 24 configured for a left foot, a notch 58 is provided on the cup 24. Preferably, notch 58 is triangular. A matching triangular tongue 59 is provided on the bottom side 25*b* of sole pad 22 for interlocking engagement with notch 58. Thus, a user can match sole pad 22 configured and dimensioned for use with a left foot with heel cup 24 that is also configured and dimensioned for use with a left foot. Similarly, sole pad 22 and heel cup 24 may be matched for a right foot and shoe. Additional indicia or side indicators may be provided to assist the user in matching sole pads and heel cups, for example lettering on each sole pad and heel cup designating the components for a left or right foot and shoe can be used.

As seen in FIGS. 6 and 7, the medial side 50*a* and the lateral side 50*b* of heel cup 24 have different contours at the free edge. For example, medial side wall 50*a* extends to a greater height $H_M$ than the height $H_L$ of lateral side wall 50*b*.

Figure 8:
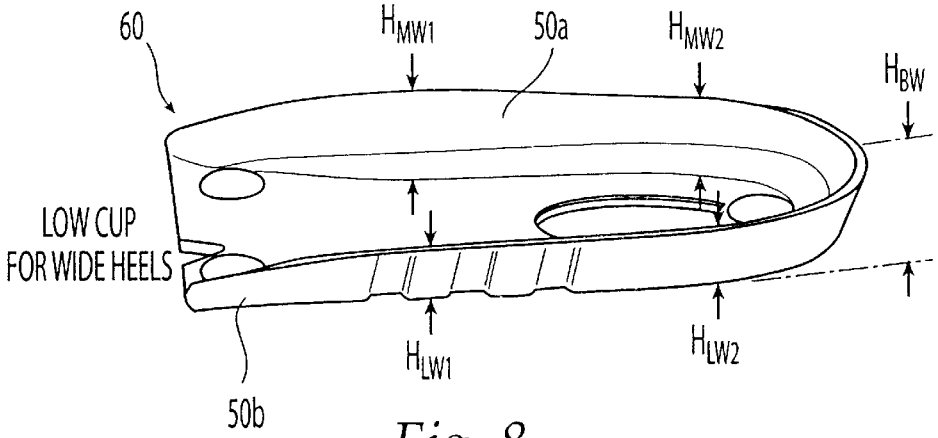
FIG. 8 is a side, perspective view of a "low" heel cup for accommodating a wide heel.
Figure 9:
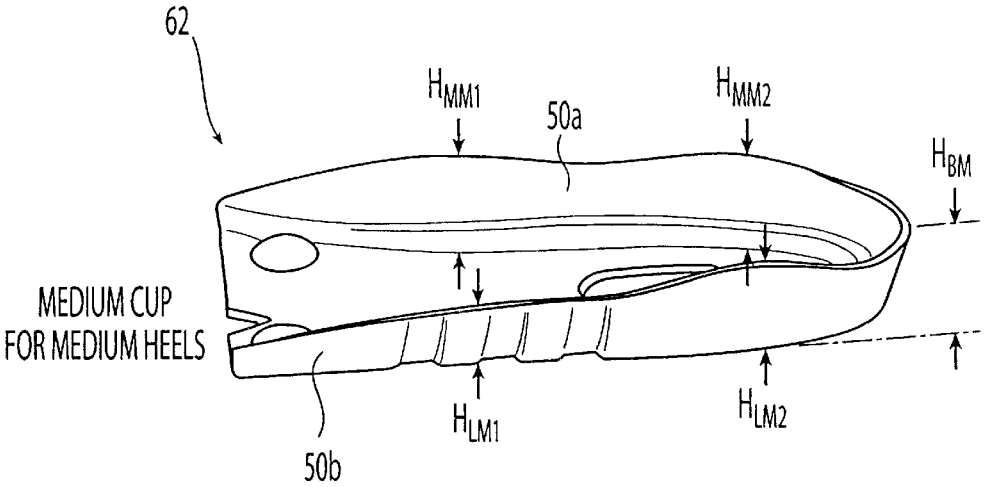
FIG. 9 is a side, perspective view of a "medium" heel cup for accommodating a medium-width heel
Figure 10:
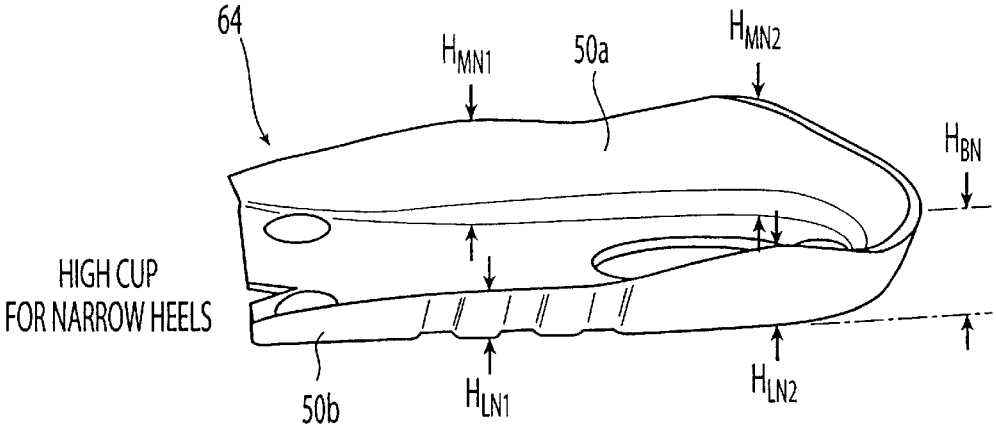
FIG. 10 is a side, perspective view of a "high" heel cup for accommodating a narrow-width heel.
Figure 11:
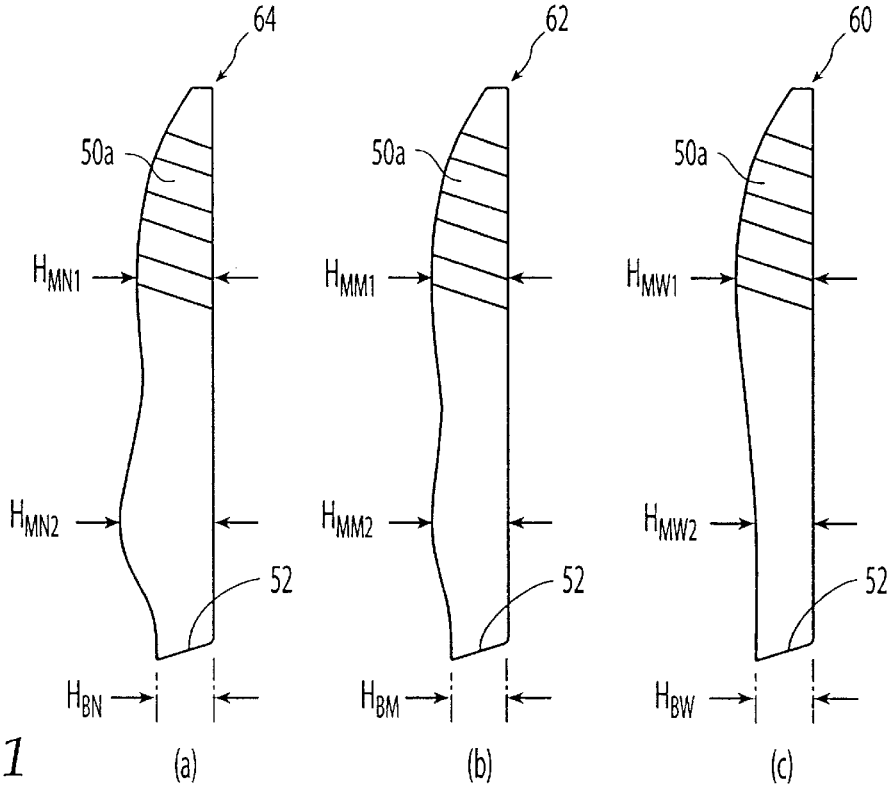
FIGS. 11*a–c* are side views of the medial side of the three different heel cups of FIGS. 8–10, respectively.
Figure 12:
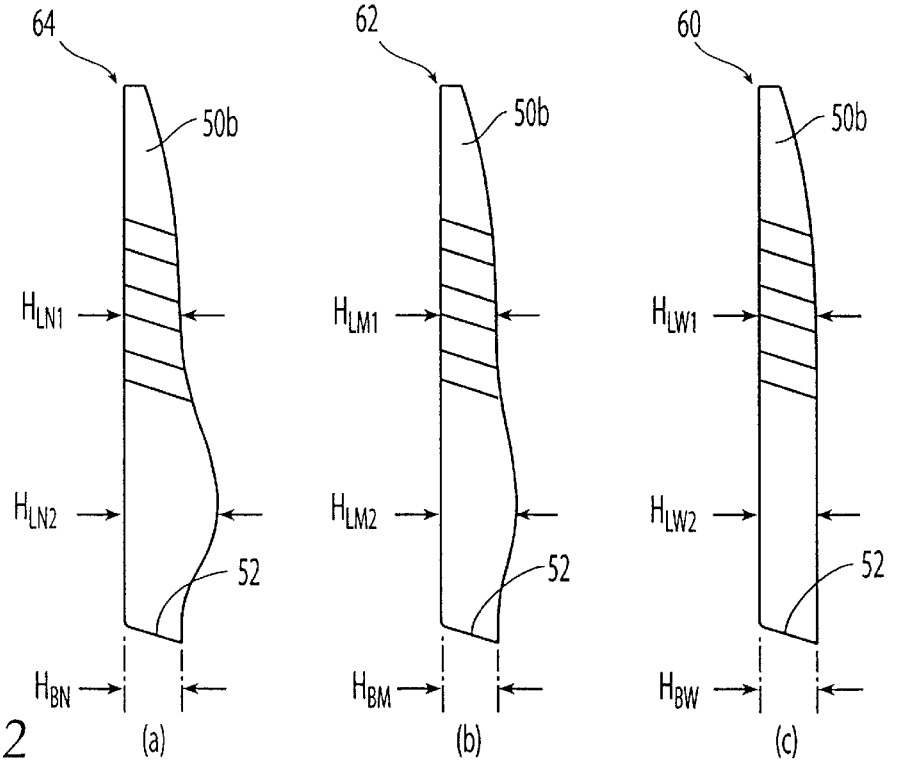
FIGS. 12*a–c* are side views of the lateral side of the three different heel cups of FIGS. 8–10, respectively.

Referring to FIGS. 8–10, the present footbed system preferably includes a set of three heel cups 60, 62, 64 having varying sizes for use with one sole pad 22 (as shown in FIG. 1). These heel cups 60, 62, 64 are designated "low", "medium", and high", respectively. Heel cups 60, 62, 64 are sized to accommodate heel widths of wide (low height walls), medium (medium height walls), and narrow (high walls), respectively. The heel cups are optionally color-coded to facilitate use, such as by using fabric coverings of blue, black, and green for heel cups 60, 62, 64. Thus, three different ranges of widths of heel sizes are accommodated with such a footbed system, and as a result, the wearer can customize the footbed by selecting the heel cup that best matches the wearer's heel width.

As shown in FIGS. 8–12, the dimensions for heel cups 60, 62, 64 are shown. Preferably, the front height of the medial side wall 50*a* remains constant for the different heel cups 60, 62, 64 or widths, such that $H_{MW1}=H_{MM1}=H_{MN1}$. The rear height of the medial side wall 50*a* decreases as heel width increases, with $H_{MN2}$ greater than $H_{MN2}$, and $H_{MM2}$ greater than $H_{HW2}$. Similarly, the front height of the lateral side wall 50*b* remains constant for the different heel cup sizes, such that $H_{LW1}=H_{LM1}=H_{LN1}$, while the rear height of the lateral side wall 50*b* decreases as heel width increases, with $H_{LN2}$ greater than $H_{LM2}$, and $H_{LM2}$ greater than $H_{LW2}$. As used herein, subscripts when read from left to right refer to the side with M for medial or L for lateral, the heel width accommodated with N for narrow, M for medium, or W for wide, and the location of measurement with 1 for the front location and 2 for the rear location.

The height of each back wall 52 remains constant for the different heel cup sizes, such that $H_{BW}=H_{BM}=H_{BN}$, where the subscripts when read from left to right refer to B for back wall, and the heel width accommodated with N for narrow, M for medium, or W for wide. Most preferably, the front and rear heights of the medial and lateral side walls, as well as the height of the back walls, are the values listed in Table I.

The thickness of the side walls also changes between cups so that the volume of the side walls for the low cup is less than the volume of the side walls for the high cup.

EXAMPLE

These and other aspects of the present invention may be more fully understood with reference to the following non-limiting example, which is merely illustrative of one embodiment of the present invention footbed system. Commonly, the dimensions will vary depending on the footbed dimensions built into the last, which is the form around which the shoe is made. Thus, this embodiment is not to be construed as limiting the invention, the scope of which is defined by the appended claims.

Table I sets forth dimensions for high, medium, and low heel cups of the present invention.

TABLE I

Dimensions for Three Sizes of Heel Cups.

| HEEL CUP SIZE | HIGH | MEDIUM | LOW |
|---|---|---|---|
| HEEL WIDTH | narrow | medium | wide |
| REFERENCE NUMBER OF HEEL CUP | 64 | 62 | 60 |
| COLOR | green | black | blue |
| MEDIAL FRONT HEIGHT | 22 mm ($H_{MN1}$) | 22 mm ($H_{MM1}$) | 22 mm ($H_{MW1}$) |
| MEDIAL REAR HEIGHT | 27 mm ($H_{MN2}$) | 22 mm ($H_{MM2}$) | 16.5 mm ($H_{MW2}$) |
| LATERAL FRONT HEIGHT | 16.5 mm ($H_{LN1}$) | 16.5 mm ($H_{LN1}$) | 16.5 mm ($H_{LN1}$) |
| LATERAL REAR HEIGHT | 27 mm ($H_{LN2}$) | 22 mm ($H_{LM2}$) | 16.5 mm ($H_{LW2}$) |
| BACK WALL HEIGHT | 16.5 mm ($H_{BN}$) | 16.5 mm ($H_{BM}$) | 16.5 mm ($H_{BW}$) |
| THICKNESS AT FRONT LOCATION | 6 mm | 4 mm | 4 mm |
| THICKNESS AT REAR LOCATION | 8 mm | 4 mm | 2 mm |
| THICKNESS OF BACK WALL | 6 mm | 4 mm | 4 mm |

As seen from the dimensions above, the front heights of the medial and lateral side walls each remains constant for high, medium, and low heel cup sizes. Furthermore, the rear heights of the medial and lateral side walls decrease as heel width increases. The back wall heights remain constant for high, medium, and low heel cup sizes.

All of the thickness measurements above are taken at the same vertical position on each heel cup side wall. The thickness at the front location is the thickness of both the medial and lateral walls at the position 1 in FIGS. 11*a*–*c* and 12*a*–*c*. The front location thickness of the high cup 64 for narrow heels is greater than the front thickness of the medium and low cups at the front position. The thickness at the rear position is the thickness of both the medial and lateral walls at the position 2 in FIGS. 11*a*–*c* and 12*a*–*c*. The thickness of the high cup 64 for narrow heels is greater than the thickness of the medium cup 62 for medium width heels. The thickness of the medium cup 62 is greater than the thickness of the low cup 60 for wide heels. The thickness of the back wall is the thickness of the wall 52 in FIGS. 11*a*–*c* and 12*a*–*c*. The back wall thickness of the high cup 64 is greater than the back wall thicknesses of the remaining cups.

As a result of the height and thickness variations of the side walls between cups, the volume of the side walls of the high cup 64 is greater than the same volume of the medium cup 62, and the side wall volume of the medium cup 62 is greater than the side wall volume of the low cup 60. Thus, the high cup for use with narrow heels has a larger side wall volume to fill gaps between the foot and the shoe when compared to the other cups for use with wider heels.

Figure 13:
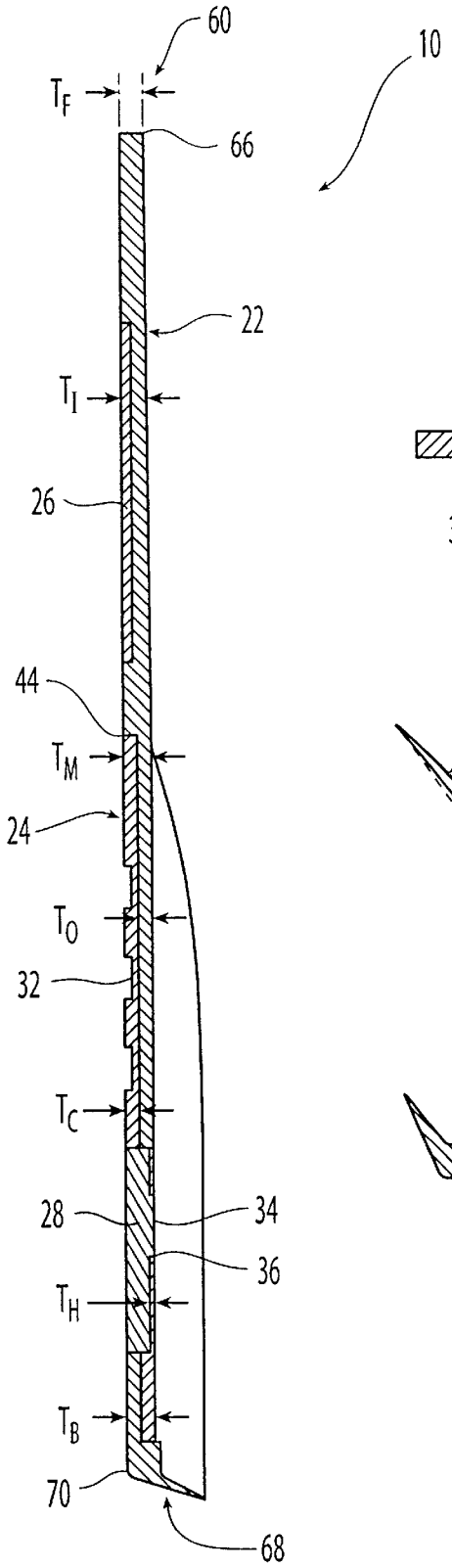
FIG. 13 is a cross-sectional view of the footbed system shown in FIG. 5 along the line 13—13 of FIG. 5 without a cushion.

Referring to FIG. 13, when the sole pad 22 and heel cup 24 are mated, preferably there is a slight taper such that the thickness $T_F$ of sole pad 22 at front end 66 is less than the combined thickness $T_B$ of sole pad 22 and heel cup 24 near back end 68. Most preferably, the combined thickness of the sole pad 22 and heel cup 24, $T_M$, near the front edge 44 of heel cup 24 is equivalent to the combined thickness $T_B$ near the rear end 68.

In a preferred embodiment, sole pad 22 has a thickness $T_F$ at front end 66 of about 5.0 mm, a thickness $T_M$ near the front edge 44 of heel cup 24 of about 6.0 mm, and a thickness $T_B$ at back end 68 of about 6.0 mm. There is a slight taper from the front end 66 of the sole pad 22 to front edge 44 of heel cup 24, such that the intermediate thickness, $T_I$, of the sole pad is about 5.5 mm. Preferably, the heel cup 24 has a primary cup thickness, $T_C$, of about 3.0 mm, and the portion of sole pad 22 overlaying heel cup 24 also has a thickness $T_O$ of about 3.0 mm. Each indentation 32 on heel cup 24 has a depth of about 1.5 mm, and the portion of sole pad 22 surrounding protrusion 34 in locating hole 36 preferably has a thickness, $T_H$, of about 1.0 mm. Furthermore, a lower rear edge 70 of heel cup 24 is rounded.

Figure 16:
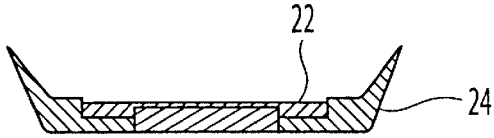
FIG. 16 is a cross-sectional view of the footbed system shown in FIG. 5 along the line 16–16of FIG. 5.

FIGS. 14–16 show cross-sections of the footbed system 10 (as shown in FIG. 5) at various longitudinal positions. In a preferred embodiment, recess peripheral portion 31 has a depth $D_I$ of 1.5 mm to accommodate the peripheral edge of the cover 27*a* (as shown in FIG. 1) on cushion 27 that extends to peripheral edge 31*a*. Preferably, the recess 30 has a total depth $D_2$ of about 3.0 mm, including the depth of recess peripheral portion 31 used for sealing the cover to sole pad 22.

A kit for custom fitting a user's foot in a shoe can also be provided. For example, a sole pad 22 (as shown in FIG. 1) and a set of three heel cups 60, 62, 64 (as shown in FIGS. 8–10) having varying sizes, as discussed above, can be provided for each shoe, packaged together so that the wearer of the shoe can customize the fit in the heel area of the shoe to improve performance. The heel cups and pad can be provided with shoes at the time of sale, or the footbed system may be offered separately for use with existing shoes. The degree of support for each foot can thus be individually selected, and different sized heel cups can even be chosen for use simultaneously, one in each of the left and right shoes of a user.

The present invention also involves a method of providing variable fit for a shoe. At least one sole pad is initially provided with a number of heel cups of variable sizes to accommodate different heel widths. The user selects the heel cup that provides a preferred fit for a particular foot based on heel width. The sole pad is detachably connected to the selected heel cup to form a footbed. The sole pad and heel cup are inserted into the shoe. This is repeated for the user's second foot.

While it is apparent that the invention herein disclosed is well calculated to fulfill the objects above stated, it will be appreciated that modifications and other embodiments may be devised by those skilled in the art. For example, the height of the front side walls of the cups can be varied between cups, as can the height of the back wall. In addition, the sole pad can be provided with side walls adjacent the forefoot of the wearer. Sole pads of different sizes and/or different configurations can be provided with each system. Alternatively, sole pads can be provided in an oversized configuration that can include a trimming grid for selective shaping by the user. Likewise, heel cups can include oversize portions with a trimming grid. Furthermore, sets of two or more heel cups are contemplated for each footbed system. Thus, although the aforementioned footbed system contained three heel cups and one sole pad for each shoe, other systems may include a different number of heel cups and sole pads. The present invention is not limited to the heel cup lengths disclosed above. Alternatively, the heel cups can extend the length of the foot and form part of a set with various volumes of sidewalls in the rearward portion. The embodiments above can be modified so that some features of one embodiment are used with the features of another embodiment. It is intended that the appended claims cover all such modifications and embodiments as fall within the true spirit and scope of the present invention.

What is claimed is:

1. A shoe, comprising:

a sole pad;

a first heel cup including a first base and a first side wall extending upwardly from the first base, the first heel cup having a first volume of the first side wall; and a second heel cup including a second base and a second side wall extending upwardly from the second base, the second heel cup having a second volume of the second side wall, the second volume being different from the first volume;

wherein the heel cups are interchangeably coupled to the sole pad; and wherein the first heel cup further includes a first height of the first side wall and the second heel cup further includes a second height of the second side wall, wherein said second height is different from the first height so that the second volume is different from the first volume.

2. The shoe of claim 1, wherein the first and second sidewalls are adjacent a user's heel.

3. The shoe of claim 1, wherein the first heel cup further includes a first thickness of the first side wall and the second heel cup further includes a second thickness of the second side wall, wherein said second thickness is different from the first thickness so that the second volume is different from the first volume.

4. The shoe of claim 1, wherein the first and second heights are on the medial and lateral portions of each side wall adjacent the user's heel.

5. The shoe of claim 1, further including a third heel cup including a third base and a third side wall extending upwardly from the third base, the third heel cup having a third volume of the third side wall, the third volume being different from the first and second volumes.

6. The shoe of claim 1, further including at least one sole pad for coupling at least one of the heel cups thereto.

7. The shoe of claim 6, wherein the sole pad extends substantially the length of the user's foot, and each heel cup has a length shorter than the sole pad length.

8. The shoe of claim 6, wherein a cushion is coupled to the lower surface of the sole pad in a forefoot region.

9. The shoe of claim 8, further including a viscoelastic damper coupled to the lower surface of the sole pad in a heel region.

10. The shoe of claim 6, further including fasteners for detachably connecting the sole pad to at least one heel cup.

11. The shoe of claim 6, further including side indicators on the heel cups and sole pad.

12. The shoe of claim 11, further including color coding on the heel cups and sole pad.

13. A shoe, comprising:

a sole pad;

a selected heel cup selected from a group of heel cups, the group of heel cups including a first heel cup and a second heel cup;

wherein the first heel cup includes a first base and a first side wall extending upwardly from the first base, the first side wall having a first volume;

wherein the second heel cup includes a second base and a second side wall extending upwardly from the second base, the second side wall having a second volume, the second volume being different than the first volume; and wherein the heel cups of the group of heel cups are interchangeably coupleable to the sole pad wherein the first side wall is of a first height and the second side wall is of a second height, wherein the second height is different than the first height so that the second volume is different than the first volume.

14. The shoe of claim 13, wherein the first and second sidewalls are positioned to be adjacent a user's heel.

15. The shoe of claim 13, wherein the first side wall is of a first thickness and the second side wall is of a second thickness, wherein the second thickness is different than the first thickness so that the second volume is different than the first volume.

16. The shoe of claim 13, wherein the first and second heights are on the medial and lateral portions of each side wall to be adjacent a user's heel.

17. The shoe of claim 13, wherein the group of heel cups further includes a third heel cup including a third base and a third side wall extending upwardly from the third base, the third side wall having a third volume, the third volume being different than the first and second volumes.

18. The shoe of claim 13, wherein the sole pad extends substantially the length of a user's foot, and the selected heel cup has a length shorter than a length of the sole pad.

19. The shoe of claim 13, wherein a cushion is coupled to a lower surface of the sole pad in a forefoot region.

20. The shoe of claim 19, further including a viscoelastic damper coupled to the lower surface of the sole pad in a heel region.

21. The shoe of claim 13, further including fasteners for detachably connecting the sole pad to the selected heel cup.

22. The shoe of claim 13, further including side indicators on the selected heel cup and sole pad.

23. The shoe of claim 22, further including color coding on the selected heel cup and sole pad.

* * * * *